US007184692B2

(12) United States Patent
Kwon

(10) Patent No.: US 7,184,692 B2
(45) Date of Patent: Feb. 27, 2007

(54) STRUCTURE TO MAINTAIN STEADY ROTATION SPEED OF AN OPTICAL PHOTOCONDUCTOR IN AN ELECTROPHOTOGRAPHIC IMAGE FORMING APPARATUS

(75) Inventor: Se-il Kwon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 136 days.

(21) Appl. No.: 10/978,529

(22) Filed: Nov. 2, 2004

(65) Prior Publication Data

US 2005/0158077 A1 Jul. 21, 2005

(30) Foreign Application Priority Data

Jan. 20, 2004 (KR) ..... 10-2004-0004431

(51) Int. Cl.
*G03G 15/00* (2006.01)

(52) U.S. Cl. ..... 399/167; 399/117

(58) Field of Classification Search ..... 399/116, 399/117, 159, 167
See application file for complete search history.

(56) References Cited

U.S. PATENT DOCUMENTS 5,420,664 A * 5/1995 Miwa et al. ..... 399/167
6,175,705 B1 * 1/2001 Harada et al. ..... 399/117

FOREIGN PATENT DOCUMENTS

| | | | |
|---|---|---|---|
| JP | 05-072836 | * | 3/1993 |
| JP | 06-193680 | | 7/1994 |
| JP | 07-42773 | | 2/1995 |
| JP | 10-340029 | | 12/1998 |
| JP | 2000-240726 | | 9/2000 |
| JP | 2003-76092 | | 3/2003 |
| JP | 2003-98903 | | 4/2003 |
| KR | 10-310999 B1 | | 9/2001 |

* cited by examiner

*Primary Examiner*—Sandra L. Brase
(74) *Attorney, Agent, or Firm*—Stanzione & Kim, LLP

(57) ABSTRACT

A structure to maintain a steady rotation speed of an optical photoconductor in an electrophotographic image forming apparatus. The structure includes a frame; an optical photoconductor which has a cylindrical shape on an outer surface of which an electrostatic latent image is formed by an optical scan, the optical photoconductor comprising a looped protrusion protruding from an end portion in a lengthwise direction of the optical photoconductor and a rotation shaft installed to be capable of rotating with respect to the frame; a damper installed at an end of the optical photoconductor, the damper comprising a core having a through hole, through which the rotation shaft of the optical photoconductor passes, and a wing, which extends from an outer circumference of the core, contacts and presses an inner circumference of the looped protrusion; and a rotation preventing unit which prevents the damper from rotating depending on rotation of the optical photoconductor.

34 Claims, 5 Drawing Sheets

STRUCTURE TO MAINTAIN STEADY ROTATION SPEED OF AN OPTICAL PHOTOCONDUCTOR IN AN ELECTROPHOTOGRAPHIC IMAGE FORMING APPARATUS

CROSS-REFERENCE TO RELATED APPLICATIONS

This application claims the priority of Korean Patent Application No. 2004-4431, filed on Jan. 20, 2004, in the Korean Intellectual Property Office, the disclosure of which is incorporated herein in its entirety by reference.

BACKGROUND OF THE INVENTION

1. Field of the Invention

The present general inventive concept relates to an electrophotographic image forming apparatus, and more particularly, to a structure to maintain steady rotation speed of an optical photoconductor in an electrophotographic image forming apparatus.

2. Description of the Related Art

Generally, an electrophotographic image forming apparatus supplies a developer, i.e., a toner, to an electrostatic latent image, which is formed on a surface of an optical photoconductor using an optical scan, to convert the electrostatic latent image into a toner image and transfers and fuses the toner image onto a print medium, thereby printing a desired image.

The optical photoconductor on which the electrostatic latent image is formed needs to maintain steady rotation in accordance with a speed at which a print medium such as a paper is fed. When the rotation speed of the optical photoconductor changes due to a temporal disturbance, deterioration of print quality, referred to as "jitter" may occur in an image printed onto the paper. In the meantime, when the optical photoconductor and a developer roller, which supplies the toner to the optical photoconductor, are rotated by a rotation device other than a gear, which couples the optical photoconductor and the developer roller, such as drive shafts, to which the optical photoconductor and the developer roller are separately connected within the electrophotographic image forming apparatus, a linear velocity of an outer circumference of the developer roller is typically about 1.2 times greater than that of the optical photoconductor in order to efficiently supply the toner to the optical photoconductor. Due to such difference in linear velocity, a torque is applied to the optical photoconductor which is in contact with the developer roller, and thus the rotation speed of the optical photoconductor may be increased.

To prevent such change in a rotation speed of an optical photoconductor, structures for maintaining a steady rotation speed of an optical photoconductor have been published. FIG. 1 is a cross-section of an example of a conventional structure for maintaining a steady rotation speed of an optical photoconductor in an electrophotographic image forming apparatus.

Referring to FIG. 1, the conventional structure for maintaining a steady rotation speed of an optical photoconductor includes a frame 11 within an image forming apparatus, a optical photoconductor 20, and a damping device 30. The optical photoconductor 20 is connected to the frame 11 via a rotation shaft 23 to be capable of rotating. The damping device 30 includes a pressure member 31 which is pierced by the rotation shaft 23 and whose surface facing a flange 21 installed at an end portion of the optical photoconductor 20 a friction pad 32 is attached to, and a coil spring 33 which is pierced by the rotation shaft 23 and elastically presses the pressure member 31 toward the flange 21 at the end portion of the optical photoconductor 20.

The conventional structure shown in FIG. 1 has a problem in that the coil spring 33 applies a reaction force to the frame 11 and thus deforms the frame 11. In addition, bonding the pressure member 31 and the friction pad 32, which are made of different materials, increases manufacturing costs.

Besides the conventional structure shown in FIG. 1, another conventional structure using a torsion spring installed at a rotation shaft of an optical photoconductor to maintain a steady rotation of the optical photoconductor has been provided. However, the effect of the torsion spring is not satisfactory since the torsion spring does not immediately respond to a torque applied to the optical photoconductor due to an external load.

SUMMARY OF THE INVENTION

The present general inventive concept provides a structure to maintain a steady rotation speed of an optical photoconductor, which is reliable and can be manufactured at a low cost, in an electrophotographic image forming apparatus.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a structure to maintain a steady rotation speed of an optical photoconductor. The structure comprises a frame; an optical photoconductor which has a cylindrical shape on an outer surface and which an electrostatic latent image can be formed by an optical scan, the optical photoconductor comprising a looped protrusion protruding from an end portion in a lengthwise direction of the optical photoconductor and a rotation shaft installed to be capable of rotating with respect to the frame; a damper installed at an end of the optical photoconductor, the damper comprising a core having a through hole, through which the rotation shaft of the optical photoconductor passes, and a wing, which extends from an outer circumference of the core, contacts and presses an inner circumference of the looped protrusion; and a rotation preventing unit which prevents the damper from rotating depending on rotation of the optical photoconductor.

The rotation preventing unit may comprise: a stopper which protrudes from the damper toward the frame; and a keeper which is formed in a surface of the frame facing the stopper to have a step, thereby keeping the stopper from rotating.

The damper may be formed by molding a high-polymer resin mixed with a lubricant.

Preferably, the lubricant comprises silicon or TEFLON® (polytetrafluoroethylene).

The wing of the damper may comprise: a friction portion which extends in a curve to be in close contact with the inner circumference of the looped protrusion of the optical photoconductor; and a pair of connection portions which connect both ends of the friction portion to the core of the damper.

The structure may further comprise a spring interposed between the core and the friction portion to reinforce a pressure of the wing against the inner circumference of the looped protrusion.

The spring is a coil spring, and the damper may further comprise a pair of protuberances which respectively protrude from the core and the friction portion and are respectively inserted into both ends of the coil spring so that the coil spring can be prevented from escaping from its place.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
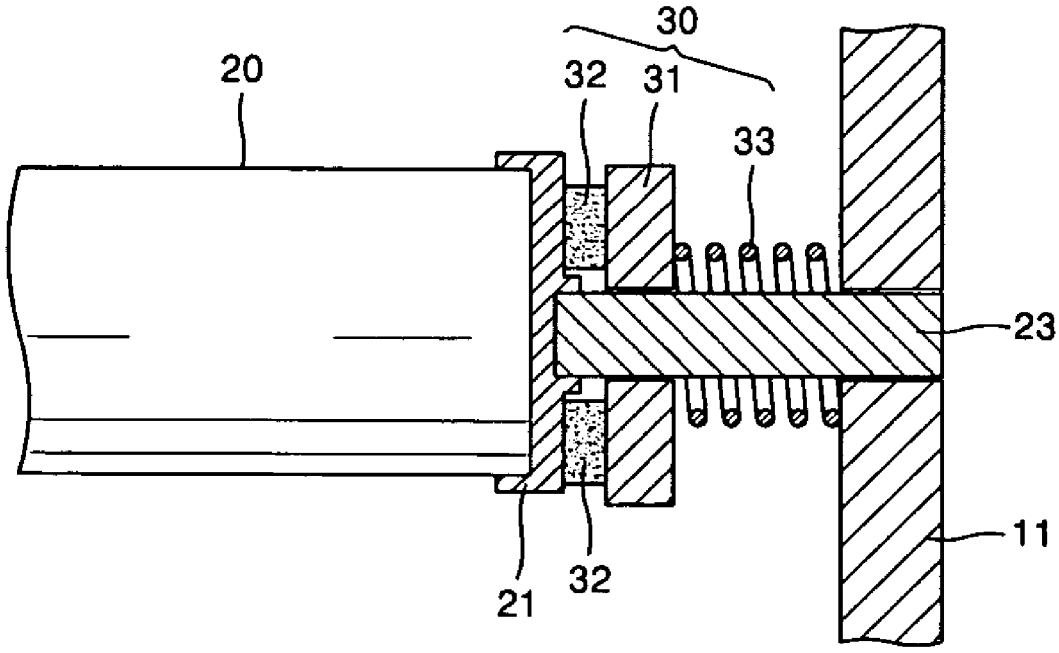
FIG. 1 (PRIOR ART)
FIG. 1 is a cross-section of an example of a conventional structure for maintaining a steady rotation speed of an optical photoconductor in an electrophotographic image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
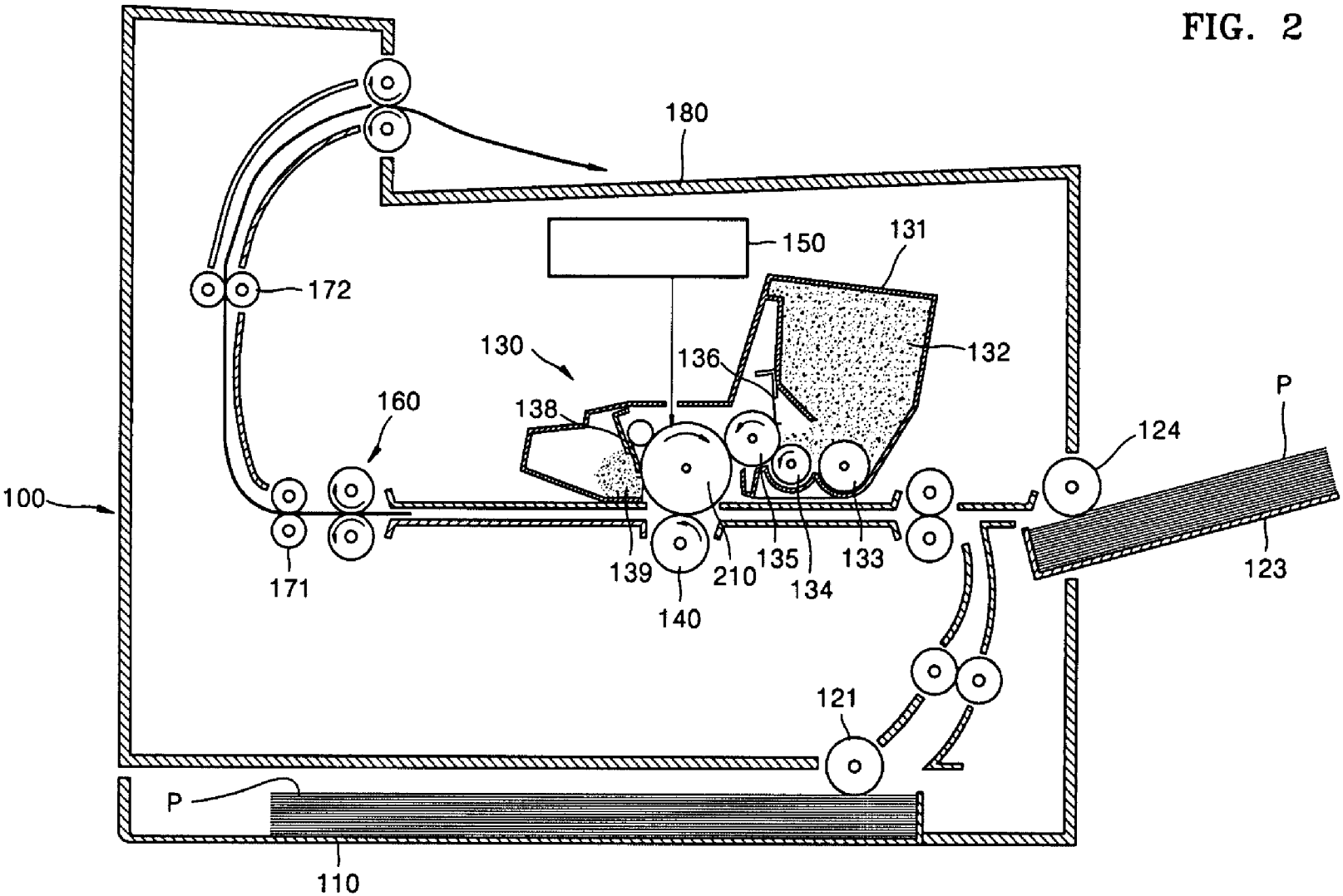
FIG. 2 illustrates an electrophotographic image forming apparatus using a structure to maintain a steady rotation speed of an optical photoconductor, according to an embodiment of the present general inventive concept.

Referring to FIG. 2, an electrophotographic image forming apparatus includes a cassette 110 containing a stack of papers P, i.e., print media, and a versatile feed rack 123 on which papers P are also stacked. The cassette 110 is removably installed at a bottom of a main body 100 of the electrophotographic image forming apparatus while the versatile feed rack 123 is installed at a side of the main body 100. Pickup rollers 121 and 124 are respectively installed above the cassette 110 and the versatile feed rack 123 to pick up the papers P one by one. A developing device 130 to develop an image and a transfer roller 140, which transfers an image developed by the developing device 130 onto a paper P, are installed at a paper transport path along which the paper P picked up by either of the pickup rollers 121 and 124 is transported.

The developing device 130 is removably installed within the main body 100 and includes a housing 131 having therewithin an optical photoconductor 210 on the surface of which an electrostatic latent image can be formed by an optical scan unit 150. The optical photoconductor 210 faces the transfer roller 140 such that a paper P passes therebetween. In addition, the developing device 130 includes a developer container 132, an agitator 133, a developer roller 135, and a supply roller 134. The developer container 132 reserves a developer, i.e., a toner. The agitator 133 is installed at a bottom of the developer container 132 and agitates the developer reserved in the developer container 132 to prevent the developer from being solid. The developer roller 135 is installed to be in contact with the optical photoconductor 210 and to be capable of rotating and supplies the developer to an electrostatic latent image formed on the surface of the optical photoconductor 210 to form a toner image. The supply roller 134 is installed in contact with the developer roller 135 and supplies the developer reserved in the developer container 132 to the developer roller 135. Also, the developing device 130 includes a doctor blade 136, which regulates a thickness of the developer attached to the surface of the developer roller 135 by the supply roller 134, and a cleaning blade 138, which removes a residual toner that is not transferred from the optical photoconductor 210 to the paper P. Meanwhile, a waste toner removed from the optical photoconductor 210 by the cleaning blade 138 is reserved in a waste toner container 139 and is then collected by a collector (not shown).

The transfer roller 140 is installed to face the optical photoconductor 210 in contact therewith and presses the paper P toward the optical photoconductor 210 so that the toner image formed on the optical photoconductor 210 is transferred to the paper P.

The toner image transferred to the paper P by the transfer roller 140 is fused on the paper P due to heat and pressure applied by a fusing roller 160 installed at the paper transport path. Thereafter, the paper P is discharged from the main body 100 by discharge rollers 171 and 172 and is stacked on a discharge plate 180.

In the electrophotographic image forming apparatus shown in FIG. 2, the optical photoconductor 210 and the developer roller 135 installed within the developing device 130 are separately connected to and rotated by different drive shafts outside the developing device 130. Since a diameter of the developer roller 135 is smaller than that of the optical photoconductor 210, an outer circumferential area of the developer roller 135 is smaller than that of the optical photoconductor 210. In this situation, if a linear velocity of an outer circumference of the developer roller 135 is the same as that of the optical photoconductor 210, a toner cannot be satisfactorily supplied to the optical photoconductor 210. Accordingly, the developer roller 135 and the optical photoconductor 210 are rotated such that the linear velocity of the outer circumference of the developer roller 135 is about 1.2 times greater than that of the optical photoconductor 210. Due to such difference in linear velocity, a torque caused by friction between the developer roller 135 and the optical photoconductor 210 is applied to the optical photoconductor 210. If the torque is not counterbalanced, a rotation speed of the optical photoconductor 210 becomes faster.

To prevent a rotation speed of the optical photoconductor 210 from changing due to the friction between the developer roller 135 and the optical photoconductor 210 or an unpredictable disturbance, a structure to maintain a steady rotation speed of an optical photoconductor according to an embodiment of the present general inventive concept is provided for the developing device 130.

Figure 3:
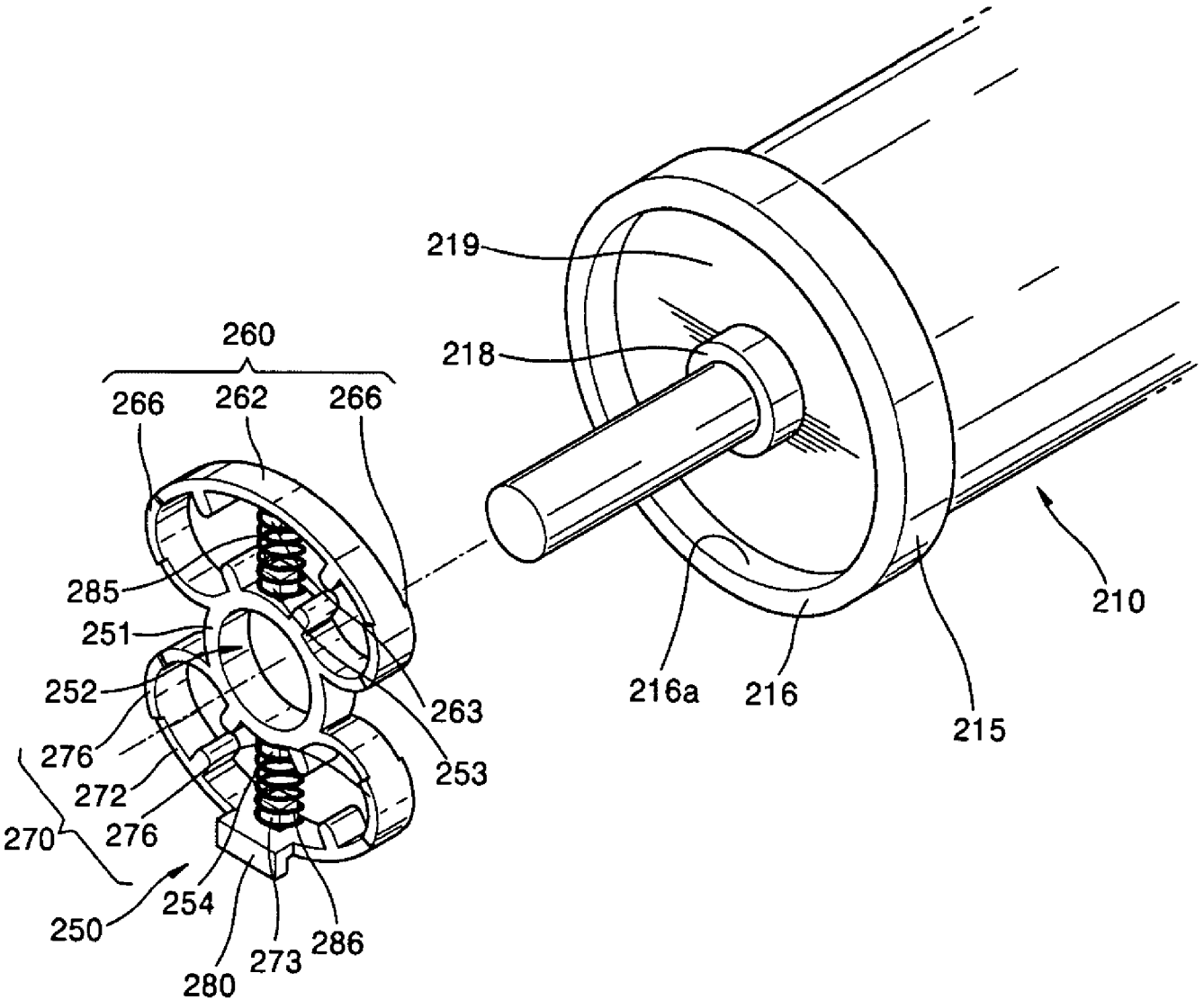
FIG. 3 is an exploded perspective view of an optical photoconductor and a damper in a structure to maintain a steady rotation speed of an optical photoconductor, according to an embodiment of the present general inventive concept.
Figure 4:
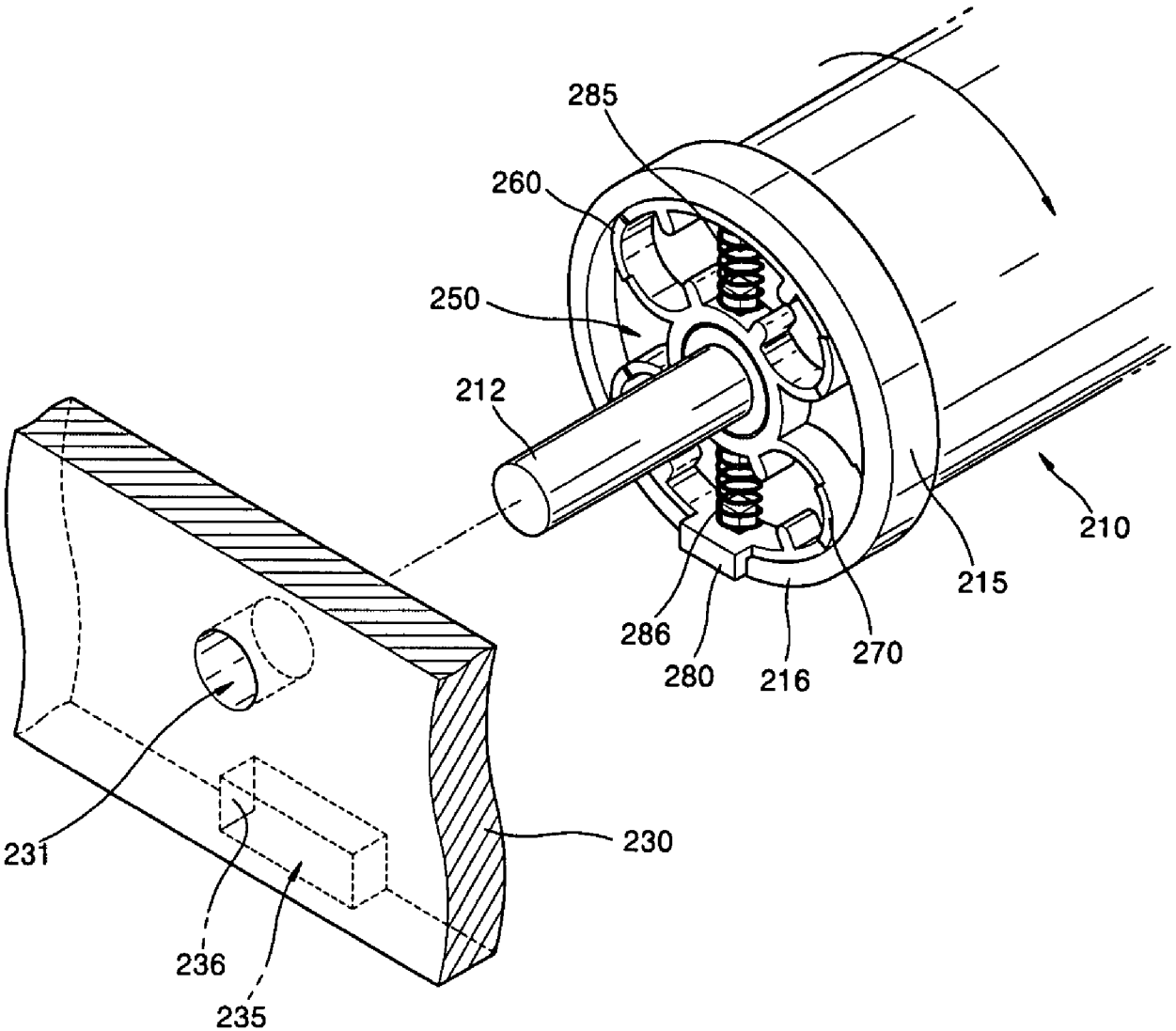
FIG. 4 is an exploded perspective view of a structure to maintain a steady rotation speed of an optical photoconductor, according to an embodiment of the present general inventive concept.

Referring to FIGS. 3 and 4, a structure to maintain a steady rotation speed of an optical photoconductor according to an embodiment of the present general inventive concept includes the optical photoconductor 210, a damper 250 installed at one end of the optical photoconductor 210, and a frame 230 supporting the optical photoconductor 210 to be capable of rotating. The frame 230 belongs to a sidewall of the housing 131 of the developing device 130 shown in FIG. 2.

The optical photoconductor 210 has a cylindrical shape. A flange 215, or a molding, is compressively attached to an end of the optical photoconductor 210. The flange 215 includes a first looped protrusion 216 extending from a rim of the flange 215 in a lengthwise direction of the optical photoconductor 210 and a second looped protrusion 218 extending from a center portion of the flange 215 in the lengthwise direction of the optical photoconductor 210. An end of a rotation shaft 212 extending in the lengthwise direction of the optical photoconductor 210 is inserted into a cylindrical hole formed by the second looped protrusion 218 to be fixed. The opposite end of the rotation shaft 212 is inserted into a through hole 231 formed in the frame 230. Although only one end of the optical photoconductor 210 is illustrated in the drawings, it can be easily understood that a rotation shaft is also provided at the opposite end of the optical photoconductor 210 and is combined with a frame to be capable of rotating. However, the rotation shaft at the opposite end of the optical photoconductor 210 is connected to a drive shaft outside the housing 131 (FIG. 2) and delivers a rotating force to the optical photoconductor 210.

The damper 250 is mounted on a recessed portion 219 between the first and second looped protrusions 216 and 218 of the flange 215. The damper 250 includes a core 251 with a through hole 252, through which the rotation shaft 212 passes, and a pair of wings 260 and 270, which extend from an outer circumference of the core 251 and contact and press an inner circumference 216*a* of the first looped protrusion 216 of the flange 215. The core 251 and the wings 260 and 270 are integrally formed by molding a high-polymer resin such as polyoxymethylene (POM). The wings 260 and 270 of the damper 250 are provided to induce a friction force in a direction opposite to the rotation direction of the optical photoconductor 210 using a contact between the inner circumference 216*a* of the first looped protrusion 216 and the wings 260 and 270. However, when the friction force is too great, the optical photoconductor 210 may be prohibited from rotating at an appropriate speed, friction noise may be produced, and the flange 215 or the wings 260 and 270 of the damper 250 may be worn away or deformed due to friction heat. Accordingly, when the damper 250 is molded, a high-polymer resin is mixed with a lubricant such as silicon or TEFLON®(polytetrafluoroethylene) at an appropriate ratio so that the wings 260 and 270 have a proper friction coefficient.

The wings 260 and 270 of the damper 250 include friction portions 262 and 272, respectively, which extend in a curve to be in close contact with the inner circumference 216*a* of the first looped protrusion 216, and connection portions 266 and 276, respectively, which extend to connect both ends of the friction portions 262 and 272 to the core 251. The friction portions 262 and 272 and the connection portions 266 and 276 form a gradual curve. To reinforce a pressure of the wings 260 and 270 against the inner circumference 216a of the first looped protrusion 216, coil springs 285 and 286 are interposed between the core 251 of the damper 250 and the friction portions 262 and 272, respectively. To prevent the coil springs 285 and 286 from escaping from their places, a first pair of protuberances 253 and 263 facing each other and a second pair of protuberances 254 and 273 facing each other are formed on the core 251 of the damper 250 and the friction portions 262 and 272, respectively. The protuberances 253 and 263 are respectively inserted into both ends of the coil spring 285, and the protuberances 254 and 273 are respectively inserted into both ends of the coil spring 286. The coil springs 285 and 286 can be replaced to have an appropriate elastic coefficient according to a desirable rotation speed of the optical photoconductor 210 or circumstances under which the optical photoconductor 210 is placed. In such structure, a single molding including the core 251 and the wings 260 and 270 can be used regardless of a type of image forming apparatus and a place where the image forming apparatus is used. Thus, mass production cost can be reduced.

The structure to maintain a steady rotation speed of an optical photoconductor includes a rotation preventing unit which prevents the damper 250 from rotating together with the optical photoconductor 210 rotating in an arrow direction shown in FIG. 4. The rotation preventing unit includes a stopper 280, which protrudes from the wing 270 of the damper 250 toward the frame 230, and a keeper 236, which keeps the stopper 280 from rotating. The keeper 236 is implemented by a side of a stopper receiving groove 235 formed in a surface of the frame 230 facing the stopper 280 to receive the stopper 280.

Figure 5:
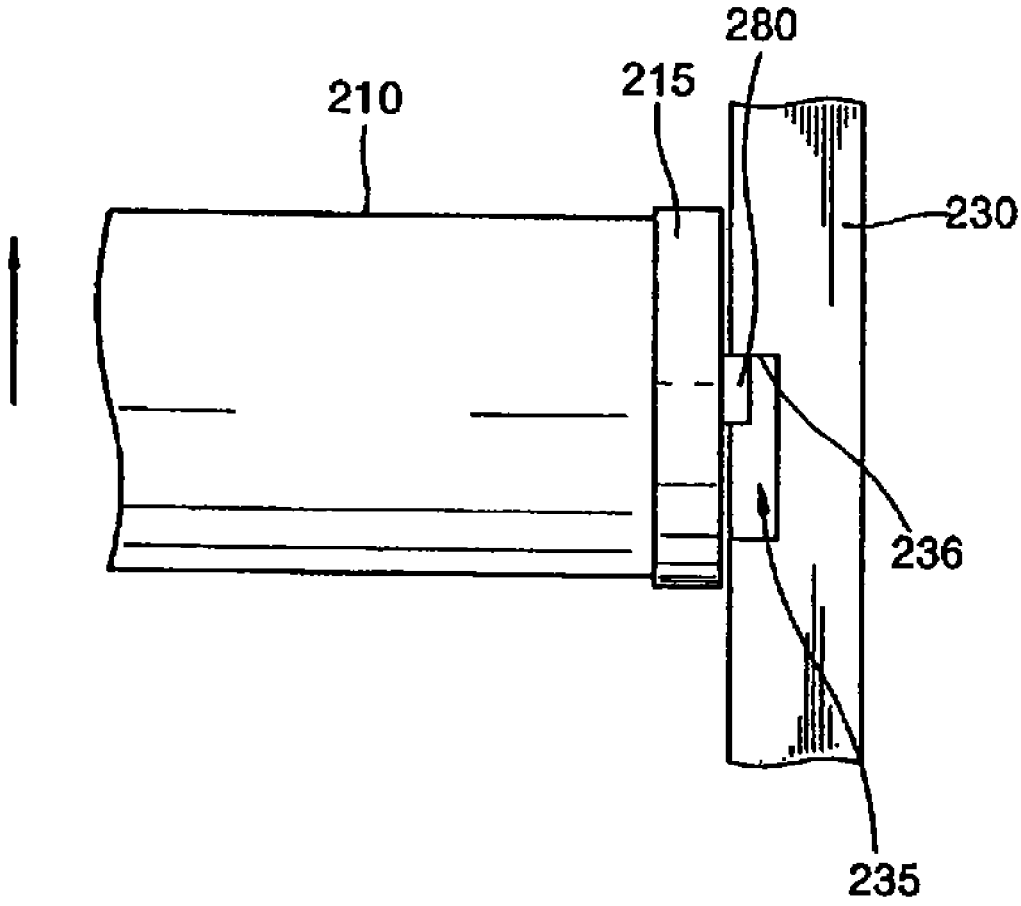
FIG. 5 is an assembled bottom view of the structure to maintain a steady rotation speed of an optical photoconductor shown in FIG. 4.

When the structure to maintain a steady rotation speed of an optical photoconductor is viewed from below, as shown in FIG. 5, the stopper 280 of the damper 250 (FIGS. 3 and 4) protrudes in the lengthwise direction of the optical photoconductor 210, is received in the stopper receiving groove 235 of the frame 230, and is in contact with the keeper 236, i.e., one side of the stopper receiving groove 235, so that the damper 250 does not rotate even though the optical photoconductor 210 rotates.

In the structure to maintain a steady rotation speed of an optical photoconductor, since the friction portions 262 and 272 of the damper 250 are curved and in contact with a wide range of the inner circumference 216*a* of the first looped protrusion 216, the friction portions 262 and 272 have a uniform pressure. As a result, abrasion and deformation of the friction portions 262 and 272 due to friction are reduced, and reliability of a friction force working in a direction opposite to the rotation direction of the optical photoconductor 210 can be secured. Accordingly, a torque applied to the optical photoconductor 210 due to a friction between the developer roller 135 (FIG. 2) and the optical photoconductor 210 or unpredictable disturbance can be counterbalanced by the reliable friction force so that a change in the rotation speed of the optical photoconductor 210 can be prevented.

An image forming apparatus using a structure to maintain a steady rotation speed of an optical photoconductor according to the present general inventive concept can reliably maintain the steady rotation speed of the optical photoconductor regardless of a friction between a developer roller and the optical photoconductor and unpredictable disturbance, so that deterioration of print quality, such as jitter, can be prevented.

In addition, according to the embodiments of the present general inventive concept, a damper can be easily manufactured by mounting coil springs to a molding, the molding can be universally used, and the spring coils can be replaced according to requirements, so that manufacturing costs of an image forming apparatus can be reduced.

Moreover, according to embodiments of the present general inventive concept, a resin mixed with a lubricant is used as a material of the molding, and the damper is in contact with a wide range of the optical photoconductor, so that friction noise and abrasion and deformation at the contact can be prevented.

While this present general inventive concept has been particularly shown and described with reference to preferred embodiments thereof, it will be understood by those skilled in the art that various changes in form and details may be made therein without departing from the spirit and scope of the general inventive concept as defined by the appended claims. For example, a structure to maintain a steady rotation speed of an optical photoconductor can also be used when the optical photoconductor is installed to a frame fixed within a main body of the image forming apparatus or when the optical photoconductor is geared with a developer roller, unlike the image forming apparatus shown in FIG. 2. Therefore, the scope of the general inventive concept is defined not by the detailed description thereof, but by the appended claims and their equivalents.

What is claimed is:

1. A structure to maintain a steady rotation speed of an optical photoconductor, the structure comprising:

a frame:

an optical photoconductor which has a cylindrical shape on an outer surface and in which an electrostatic latent image is formed by an optical scan, the optical photoconductor comprising a looped protrusion protruding from an end portion in a lengthwise direction of the optical photoconductor and a rotation shaft installed to be capable of rotating with respect to the frame;

a damper installed at an end of the optical photoconductor, the damper comprising a core having a through hole, through which the rotation shaft of the optical photoconductor passes, and a wing which extends from an outer circumference of the core, contacts and presses an inner circumference of the looped protrusion; and a rotation preventing unit which prevents the damper from rotating depending on rotation of the optical photoconductor.

2. The structure of claim 1, wherein the rotation preventing unit comprises:

a stopper which protrudes from the damper toward the frame; and a keeper which is formed in a surface of the frame facing the stopper to have a step, thereby keeping the stopper from rotating.

3. The structure of claim 1, wherein the damper is formed by molding a high-polymer resin mixed with a lubricant.

4. The structure of claim 3, wherein the lubricant comprises silicon or polytetrafluoroethylene.

5. The structure of claim 1, wherein the wing of the damper comprises:

a friction portion which extends in a curve to be in close contact with the inner circumference of the looped protrusion of the optical photoconductor; and a pair of connection portions which connect both ends of the friction portion to the core of the damper.

6. The structure of claim 5, further comprising a spring interposed between the core and the friction portion to reinforce a pressure of the wing against the inner circumference of the looped protrusion.

7. The structure of claim 6, wherein the spring is a coil spring, and the damper further comprises a pair of protuberances which respectively protrude from the core and the friction portion and are respectively inserted into both ends of the coil spring so that the coil spring can be prevented from escaping from its place.

8. A structure maintaining a steady rotation speed of an optical photoconductor rotating along a rotation shaft within an image forming apparatus, the structure comprising:

a flange including:

a first looped protrusion attached to and extending from an end portion of the optical photoconductor in a lengthwise direction, a second looped protrusion attached to and extending from the end portion of the optical photoconductor in a lengthwise direction and positioned within the first looped protrusion to make contact and rotate with the rotation shaft, and a recession portion connecting the first and second looped protrusions; and a damper fixed to the image forming apparatus and installed between the first and second looped protrusions, the damper including:

a core having a through hole through which the rotation shaft of the optical photoconductor passes, and at least one wing which extends from an outer circumference of the core to provide a frictional contact with an inner circumference of the first looped protrusion.

9. The structure of claim 8, wherein the damper further comprises a stopper extending therefrom towards a frame of the image forming apparatus to engage with the frame to prevent movement of the damper.

10. The structure of claim 8, wherein the other end of the optical photoconductor is connected to a drive shaft to deliver a rotating force to the optical photoconductor.

11. The structure of claim 8, wherein the at least one wing comprises first and second wings facing away from each other on opposite sides of the core and providing a friction force in a direction opposite to the rotation direction of the optical photoconductor by contacting an inner circumference of the first looped protrusion.

12. The structure of claim 11, wherein each of the first and second wings includes a friction portion having a gradual curve contacting the inner circumference of the first looped protrusion and first and second connection portions connecting each end of the friction portion to the core.

13. The structure of claim 12, further comprising a spring interposed between each of the friction portions and the core to reinforce a pressure of each of the wings.

14. The structure of claim 8, wherein the at least one wing includes a friction portion having a gradual curve contacting the inner circumference of the first looped protrusion and first and second connection portions connecting each end of the friction portion to the core.

15. The structure of claim 14, further comprising a spring interposed between the friction portion of the wing and the core to reinforce a pressure of the wing.

16. The structure of claim 15, further comprising proturberances provided on the core and the friction portion to face each other and to receive a respective end of the spring to keep the spring within the wing.

17. The structure of claim 15, further comprising a first and second pair of proturberances, each pair of proturberances provided on the core and a friction portion to face each other and to receive a respective end of the spring to keep the spring within the respective wing.

18. The structure of claim 8, wherein the damper is molded of a high-polymer resin mixed with a lubricant made from silicon or polytetrafluoroethylene at a predetermined ratio.

19. A structure maintaining a steady rotation speed of an optical photoconductor rotating along a rotation shaft within developing device used in an image forming apparatus, the structure comprising:

an optical photoconductor comprising a first flange extending from an end portion thereof in a lengthwise direction of the optical photoconductor, a rotation shaft extending through the photoconductor body and capable of rotating with respect to the developing device, and a second flange extending away from and surrounding the rotation shaft, the second flange sharing a same rotation axis with the first flange; and a damper installed at an end of the optical photoconductor, the damper comprising a friction member which contacts and presses an inner circumference of the first flange and a stopper member extending from the damper to an inner surface of the developing device to prevent the damper from rotating with the optical photoconductor.

20. The structure of claim 19, wherein the friction member comprises core having a through hole, through which the rotation shaft of the optical photoconductor passes, and at least one wing member extending from the core and providing a frictional contact with the inner circumference of the first flange.

21. The structure of claim 20, further comprising a spring member provided between the core and the at least one wing member to reinforce the wing against the inner circumference of the first flange.

22. A friction member used with a roller of an image forming device to control a rotation speed of the roller, the friction member comprising:

a core including a through hole in which a rotation shaft of the roller passes therethrough; and a pair of wings extending from an outer circumference of the core to contact and press an inner circumference of a flange extending from an end of the roller.

23. The friction member of claim 22, wherein the core and pair of wings are molded as one unit of a high-polymer resin mixed with a lubricant to provide a predetermined friction coefficient.

24. The friction member of claim 23, wherein the lubricant is silicon or polytetrafluoroethylene.

25. The friction member of claim 22, wherein each of the wings comprise:

a friction portion which extends in a curve to be in close contact with the inner surface of the roller flange; and connection portions which extend to connect from the ends of the friction portion to connect the frictions portions to the core.

26. The friction member of claim 25, further comprising a coil spring interposed between the core and each of the friction portions to reinforce a pressure of the wings.

27. The friction member of claim 26, further comprising:

a first pair of proturberances facing each other and formed on an inner surface of one of the pair of wings and an outer circumference of the core, respectively, to hold one of the coil springs therebetween; and a second pair of proturberances facing each other and formed on an inner surface of the other one of the pair of wings and the outer circumference of the core, respectively, to hold the other coil spring therebetween.

28. The friction member of claim 22, further comprising:

a stopper protruding from a side portion of one of the wings; and a keeper formed in a frame portion of the image forming device in which the stopper extends therein to prevent the friction member from rotating together with the roller.

29. An image forming apparatus, comprising:

a roller including a first looped protrusion formed on an end thereof; and a friction member provided within the first looped protrusion to contact an inner surface of the first looped protrusion to control a rotation speed of the roller.

30. The image forming apparatus of claim 29, further comprising:

a frame having a receiving area defined therein, and wherein the friction member comprises a stopper to protrude from the friction member and to be received within the receiving area of the frame to stop a rotation of the friction member.

31. The image forming apparatus of claim 29, wherein:

the roller further includes a second looped protrusion formed along a rotation shaft of the roller; and the friction member includes an internal area to receive the second protrusion.

32. An image forming apparatus, comprising:

a frame;

a roller having a protrusion extending from a circumferential end thereof, and a rotation shaft formed along an axis of rotation of the roller provided on the end to be rotatably supported by the frame; and a friction member to contact inner surfaces of the protrusion and provided within a space defined by the protrusion and disposed between the frame and the roller.

33. The image forming apparatus of claim 32, wherein the friction member comprises a core having a through hole defined therein to receive the rotation shaft.

34. The image forming apparatus of claim 33, wherein:

the friction member comprises friction portions to contact the inner surfaces of the protrusion; and the friction portions are biased towards the protrusion by resilient members provided on outer surfaces of the core that contact inner surfaces of the friction portions.

* * * * *